US005690867A

United States Patent [19]

Nouguez et al.

[11] Patent Number: 5,690,867

[45] Date of Patent: Nov. 25, 1997

[54] PROCESS FOR THE MANUFACTURE OF AN EXPLOSIVE AMMUNITION COMPONENT WITH CONTROLLED FRAGMENTATION

[75] Inventors: Bruno Nouguez, Vert le Petit; Claude Grimelli, Alfortville; Pierre Vitrant, Itteville; Alain Bonnel; Alain Tinet, both of Sorgues, all of France

[73] Assignee: Societe Nationale des Poudres et Explosifs, Paris Cedex, France

[21] Appl. No.: 736,249

[22] Filed: Oct. 24, 1996

[30] Foreign Application Priority Data

Nov. 16, 1995 [FR] France ..... 95 13591

[51] Int. Cl.[6] ..... C06B 21/00; F42B 12/22

[52] U.S. Cl. ..... 264/3.1; 102/492; 102/493; 102/494; 102/495; 102/506

[58] Field of Search ..... 102/492, 494, 102/495, 506, 493; 264/3.1

[56] References Cited

U.S. PATENT DOCUMENTS

| | | | |
|---|---|---|---|
| 1,325,706 | 12/1919 | Todisco | 102/494 X |
| 3,677,183 | 7/1972 | Talley | 102/67 |
| 3,850,103 | 11/1974 | Krupen | 102/70.2 P |
| 4,305,333 | 12/1981 | Altenaii et al. | 102/306 |
| 4,503,776 | 3/1985 | Nussbaum et al. | 102/496 |
| 4,583,703 | 4/1986 | Kline | 102/388 X |
| 4,870,884 | 10/1989 | Schubart | 86/20.12 |
| 5,131,329 | 7/1992 | Lips et al. | 102/364 |
| 5,189,247 | 2/1993 | Andre et al. | 102/291 |
| 5,320,043 | 6/1994 | Andre et al. | 102/291 |

FOREIGN PATENT DOCUMENTS 2685077 6/1993 France .

*Primary Examiner*—Peter A. Nelson
*Attorney, Agent, or Firm*—Bucknam And Archer

[57] ABSTRACT

The invention relates to a process for the manufacture of an explosive ammunition component with controlled fragmentation, comprising a charge of solid explosive contained in a metal casing internally clad with a sleeve externally provided with indentations.

A rigid sleeve made of plastic or elastomer, externally provided with indentations and which has a form of a vessel provided with a single opening, is produced first of all, and then this sleeve is introduced, with the bottom first, into a metal casing comprising an opening and whose shape and dimensions are such as to allow the sleeve to clad the casing internally.

A pasty or liquid explosive composition is next cast into the sleeve and the composition is then solidified.

12 Claims, No Drawings

PROCESS FOR THE MANUFACTURE OF AN EXPLOSIVE AMMUNITION COMPONENT WITH CONTROLLED FRAGMENTATION

The present invention belongs to the military field, more particularly to that of explosive ammunition, projectiles, bombs, various weapons, for example, with controlled (also called "predetermined" or "prepared") fragmentation, which are intended especially for anti-runway, antibunker or anti-vehicle (ship, tank, armoured vehicle, and the like) operations.

It relates more precisely to a new process for the manufacture of an explosive ammunition component with controlled fragmentation, comprising a solid explosive charge contained in a metal casing coated internally with a sleeve provided with indentations, for example dihedral ones, pointing towards the interior of the ammunition, that is to say towards the charge.

The regions of contact between the casing and the sleeve are therefore separated by cavities corresponding to the bulk of the indentations.

Patent FR 2 433 731 describes, for example, an explosive ammunition component with controlled fragmentation, comprising a thin-walled packing situated between the metal casing and the explosive charge and comprising indentations which are roof-shaped ribs pointing inwards. The packing, consisting of a thin sheath, provides a complete or partial internal coating of the casing.

According to an alternative form, the casing is internally smooth and is coated with a metal or plastic packing including roof-shaped ribs pointing inwards.

When the packing is made of plastic, in order to produce the explosive ammunition component, the inner parts of the mould are covered, during the manufacture of the explosive charge by moulding, with a plastic sheet plasticized by heating before the explosive is introduced in the liquid or pasty state.

The closing of the mould provided with projections results in the formation of the roof-shaped ribs.

After cooling and opening of the mould the explosive charge coated by the packing is withdrawn.

This charge and its packing must next be introduced into a metal casing of appropriate dimensions to produce the ammunition component.

Such a process using previous moulding of the explosive charge clad in the plastic sheath is lengthy and very costly at the industrial stage as a result of the numerous manufacturing operations (production of suitable moulds, surface release treatment, charge casting, solidifying, demoulding, insertion of the charge obtained into the metal structure) and of the precautions which, for obvious safety reasons, must be taken by the operators handling bare explosive charges.

In addition, the quantities of charges that can be produced simultaneously are limited by the number of available moulds. The increase in the number of the moulds makes the industrial investment very costly.

The subject-matter of the present invention is especially to provide a process which is much simpler and more economical.

The proposed solution consists in producing beforehand, especially according to simple and inexpensive industrial moulding techniques which are well known to a person skilled in the art, a rigid sleeve in the form of a vessel which has a single opening and is provided with indentations pointing inwards, in introducing this sleeve into the metal structure of the ammunition and in then subsequently performing the conventional operations of casting and solidifying of an explosive composition.

The main advantages which this process provides are the following:

- The dangerous operation of demoulding and of insertion of the explosive charge into the structure is eliminated, resulting in a gain in safety and a reduction in cost.
- The mould needed for producing the rigid sleeve is much simpler in design than that needed for moulding the explosive, for two reasons in particular. First of all, the problem of leakproofing is less crucial, or even non-existent when the technique of blow-extrusion of thermoplastics, which is well known to plastics technologists, is employed.

Furthermore, the use of plastics with a high working temperature allows single split shell moulds to be employed, taking advantage of their flexibility when hot and of their thermal shrinkage (natural contraction), whereas the traditional moulding of the explosive or the simultaneous plastic/explosive moulding requires moulds comprising a larger number of shells.

- The moulding operation itself is much more economical because the problems linked with pyrotechnic safety no longer arise. In addition, the rigid sleeves can be produced at the high rates characteristic of the plastics technology industries.
- In contrast to the abovementioned known process using simultaneous plastic/explosive moulding, it permits, by virtue of the preliminary moulding of the rigid sleeve, the use of plastics which withstand or require high forming temperatures that would be incompatible with the explosives.
- The flexibility and elasticity of many plastics or elastomers enable the process according to the invention to be employed even when the size of the opening of the metal casing is smaller than the size of the sleeve, which is not possible when operating using simultaneous plastic/explosive moulding.
- It ensures better overall contact between the casing, the sleeve and the explosive charge, and this limits the risk of untimely separation that can arise when the ammunition component is subjected to high accelerations or, on the contrary, high decelerations, for example when entering a target.

The subject of the present invention is therefore a new process for the manufacture of an explosive ammunition component with controlled fragmentation, comprising a solid explosive charge contained in a metal casing whose inner wall is coated with a sleeve provided externally with indentations, that is to say with internal notches and/or grooves. The internal wall of the casing and the external surface of the sleeve are therefore in contact through the intermediacy of projecting agents separated by cavities corresponding to the bulk of the indentations.

The process according to the invention is characterized in that a rigid sleeve made of plastic or elastomer, externally provided with indentations and which has a form of a vessel provided with a single opening, for example in the form of a case, bottle, ogival, cup or sock, is produced first of all, in general and preferably by moulding. The sleeve is next introduced into a metal casing comprising an opening and whose shape and dimensions are such as to allow the sleeve to clad the internal wall of the casing, the sleeve being introduced through the opening of the casing with the bottom first, that is to say so that the opening of the sleeve will be situated facing the opening of the casing in order to make the interior of the sleeve accessible through the opening of the casing.

A pasty or liquid explosive composition is next cast into the sleeve and the composition is then solidified.

Plastic is conventionally intended to mean any synthetic material based on the use of macromolecules and capable of being modelled or moulded, in general with heating and under pressure.

Elastomer is conventionally intended to mean any natural or synthetic polymeric material possessing elastic properties and capable of being used as a rubber.

Generally, but not necessarily, the explosive ammunition component has an axis symmetry. It preferably has, as a whole or partially, a cylindrical or ogival shape. The bottom may be flat, rounded or of any shape. In order that the sleeve may coat the casing internally, when the ammunition component has a cylindrical shape, the internal diameter of the casing is equal to the external diameter of the sleeve and, when the ammunition component has an ogival shape, the dimensions of the ogives defined by the internal wall of the casing and by the external wall of the sleeve are identical.

The sleeve wall thickness is preferably uniform or substantially uniform, especially in the peripheral region. The wall thickness of the bottom of the sleeve, that is to say of the portion of the sleeve at the opposite end to its single opening may, for example, be slightly greater, especially as a result of the above-mentioned blowing technique. The sleeve wall may be of any thickness. Nevertheless, the latter is preferably appreciably smaller than that of the metal casing, for example between 5% and 25%, preferably approximately 10%, of the casing thickness.

The indentations may be of any shape but are preferably dihedral, roof-shaped, the ridge of the dihedral being situated towards the interior of the sleeve.

The dihedrals may comprise a multislope, for example double slope, angular opening in relation to their plane of symmetry.

Whether dihedral or not, the indentations are preferably identical and, particularly preferably, when the sleeve has a cylindrical shape, they are distributed as crown rings of the same height comprising an identical number of identical indentations, the indentations being uniformly distributed on each crown ring and situated alternating with the indentations of the higher crown ring and those of the lower crown ring. Along a generatrix, each indentation is thus situated between two nonindented projecting regions of the two adjacent crown rings, and the projecting surfaces, in contact with the casing, are identical and uniformly spaced, alternating between one crown ring and another, and representing approximately a chequerboard pattern.

The bottom of the sleeve is generally smooth and devoid of indentations. This is also the case with the portion of the sleeve which is situated near the opening.

To give an illustration, in the case of a cylindrical sleeve only the peripheral region comprises indentations. The two faces, which may, for example, be approximately planar and parallel, forming the bottom and the region in which the opening is to be found are devoid thereof.

The ridges of the sleeve connecting the peripheral region and the two planar faces may be rounded.

According to another preferred alternative form of the invention the internal and external walls of the metal casing are not weakened, that is to say they are substantially smooth, devoid of ribs and/or grooves which initiate fissures whose network predetermines the subsequent fragments.

This method of controlled fragmentation through weakening of the casing cannot always be employed, especially in the case of the warheads intended to enter a target before functioning ("piercers"), or which are to be subjected to high accelerations (shell), since the casing runs the risk of being damaged before functioning as a result of its excessive weakness.

In this configuration the controlled fragmentation is provided solely by the shearing load action due to the dihedral indentations of the sleeve.

In these situations, in the case of which it is not possible to make the casing weaker, it is well known to a person skilled in the art to produce an explosive charge exhibiting a multitude of dihedrals on its peripheral face in contact with the metal casing, but such ammunition can be produced only by integral moulding of the charge beforehand, with all the disadvantages which have been discussed above, or by moulding followed by a machining operation, which is still more costly.

The present invention is therefore particularly advantageous to use in these situations.

According to another preferred alternative form of the invention the plastic or elastomer forming the rigid sleeve in the form of a vessel provided with a single opening is chosen from the group consisting of polyalkylenes, natural elastomers and synthetic elastomers, preferably a low or high-density polyethylene.

The sleeve may be manufactured by any moulding or extrusion technique, but it is preferred to employ the blow-extrusion technique, well known to plastics technologists, which is widely employed for the manufacture of plastic bottles, which is simple, inexpensive and permits high output rates.

The sleeve must be sufficiently rigid to withstand the pressure of the pasty or liquid explosive compositions when the latter are introduced.

When the sleeve is made of polyethylene and, more generally, when it has sufficient flexibility and elasticity to be compressed without damage, then it is possible to introduce, through the opening of the casing, a sleeve which is larger in size than the size of the opening of the casing.

To do this it suffices to compress the sleeve beforehand to a size which allows it to be introduced into the casing.

Once inside the casing the sleeve recovers its original shape and size and clads the casing internally.

According to another alternative form of the invention the castable explosive composition consists of a filled polymerizable organic binder in which the filler contains at least one organic nitro explosive and the composition is solidified by polymerizing the binder. A charge of the cast plastic-bonded explosive type is thus obtained.

The casting of the explosive composition in the sleeve can be carried out at atmospheric pressure or by pressure injection or by gravity under a vacuum.

Examples of organic nitro explosives which may be mentioned are RDX, HMX, pentrite, 5-oxo-3-nitro-1,2,4-triazole (ONTA) and mixtures of at least two of these compounds.

Examples of polymerizable organic binder which may be mentioned are those making it possible to obtain, after polymerization, for example by heating, a filled solid polymeric matrix of polyurethane or polyester type which optionally has energetic groups such as fluoro, nitro and/or azide groups.

The polyurethane matrices are generally obtained by a reaction of a prepolymer containing hydroxyl ends with a polyisocyanate.

Examples of prepolymers containing hydroxyl ends which may be mentioned are those in which the backbone is a polyisobutylene, a polybutadiene, a polyether, a polyester, a polysiloxane. A polybutadiene with hydroxyl ends is preferably employed.

Examples of polyisocyanates which may be mentioned are isophorone diisocyanate (IPDI), toluene diisocyanate (TDI), dicyclohexylmethylene diisocyanate (Hylene W), hexamethylene diisocyanate (HMDI), biuret trihexane isocyanate (BTHI) and their mixtures.

When the polymer matrix is a polyester matrix, it is generally obtained by a reaction of a prepolymer containing carboxyl ends, preferably a polybutadiene with carboxyl ends (CEPB) or a polyester with carboxyl ends, with a polyepoxide, for example condensate of epichlorohydrin and glycerol, or a polyaziridine, for example trimethylaziridinylphosphine oxide (MAPO).

The polymerizable organic binder may optionally include an inert or active plasticizer, such as those usually employed in the processing of plastic-bonded explosives by casting.

Besides the organic nitro explosive the filler may optionally include, for example, an inorganic oxidizer such as ammonium perchlorate and/or a reducing metal such as aluminum.

According to another alternative form of the invention the castable explosive composition is made up of an organic nitro explosive granular filler suspended in a fusible explosive in the molten state and the composition is solidified by lowering the temperature. A so-called "melt-cast" solid charge is thus obtained, made up of a fusible explosive matrix such as trinitrotoluene (TNT), which melts at 80° C., coating a granular explosive filler such as RDX, HMX or ONTA.

Melt-cast explosive compositions, like furthermore in general the abovementioned plastic-bonded explosives produced by casting, are well known to a person skilled in the art.

According to another alternative form of the invention the solid explosive charge is a dual-composition charge including a central composition coated with a peripheral composition.

The dual-composition explosive charges and processes for obtaining them from pasty or liquid castable explosive compositions are well known to a person skilled in the art.

Within the scope of the present invention preference is given to those in which the peripheral composition is less sensitive to the shock wave than the central composition, like, for example, those described in patents FR 2 668 146 and FR 2 678 262.

After the sleeve has been introduced into the metal casing a removable pin, for example, is introduced into the sleeve and then the liquid or pasty peripheral composition is cast into the space situated between the pin and the inner wall of the sleeve. After solidifying, the pin is withdrawn and then the liquid or pasty central composition is cast into the space released by the pin, and is subsequently solidified.

EXAMPLE 1

A cylindrical explosive ammunition component with controlled fragmentation is produced by making use of the process according to the invention, comprising a plastic-bonded composite explosive charge contained in a cylindrical casing made of steel the internal wall of which is clad with a cylindrical sleeve made of plastic provided externally with indentations.

The steel casing, of 10 mm thickness, has an external diameter of 280 mm and an internal diameter of 260 mm. Its height is 500 mm. It comprises an approximately flat bottom and the face at the opposite end to the bottom is fully open (circular opening 260 mm in diameter). The casing is not weakened. The internal and external walls are smooth.

The sleeve consists of a cylindrical case-shaped vessel made of high-density polyethylene, comprising an approximately flat bottom and an opening in the approximately planar face at the opposite end to the bottom.

This sleeve has an external diameter of 260 mm and comprises 28 crown rings 17 mm in height including 52 identical indentations uniformly spaced per turn, in the form of dihedral grooves parallel to the axis of the sleeve and 6 mm in depth. The length of each groove is 17 mm, namely the height of each crown ring, the ridge of each dihedral is situated inside the sleeve and the dihedral angle is 90°. On each crown ring the dihedral indentations are situated alternating with the indentations of the higher crown ring and those of the lower crown ring. Each indentation is thus situated between two nonindented projecting regions of the two adjacent crown rings and the projecting surfaces, in contact with the steel casing, are identical, uniformly spaced, alternating between one crown ring and another, and represent approximately a chequerboard pattern with approximately rectangular squares.

A rounding-off of 12 mm radius connects the cylindrical portion and the bottom. Another rounding-off of the same radius connects the same cylindrical portion and the face at the opposite end from the bottom, which includes an axial circular opening 90 mm in diameter.

The thickness of the sleeve, more precisely the thickness of the plastic forming it, is approximately uniform, of the order of 1 mm.

It varies between 0.8 mm and 1.2 mm according to the regions.

This sleeve, made of high-density polyethylene, was first of all obtained by the blow-extrusion technique starting with a mould adapted to the dimensions and the required abovementioned configuration. The die exit temperature was 170° C.

The sleeve was next introduced into the casing through the opening of the steel casing, the bottom of the sleeve being introduced first.

The opening of the sleeve thus faces the opening of the casing, and this allows the interior of the sleeve to be made accessible through the opening of the casing.

Taking into account the shape and the dimensions of the sleeve and of the steel casing, the sleeve clads the internal wall of the casing, the sleeve and the casing being in contact through the intermediacy of the projecting external surfaces of the sleeve, and via the bottom.

A pasty explosive composition consisting of 12% by weight of HMX, 72% by weight of 5-oxo-3-nitro-1,2,4-triazole (ONTA) and 16% by weight of a polymerizable organic binder based on polybutadiene with hydroxyl ends (HEPB) with a mass of approximately 2000 and on isophorone diisocyanate is next cast into the sleeve at 60° C.

The composition is solidified by polymerizing the binder by heating for 7 d at 60° C.

The initiation of the charge was then produced with the aid of a planar wave generator (PWG) of 90 mm diameter reinforced with a cylinder of the same diameter and of 45 mm height made of plastic-bonded explosive with a polyether plastic binder with hydroxyl ends crosslinked with IPDI of weight composition 86% HMX and 14% crosslinked binder.

After detonation of the explosive ammunition component and recovery of the fragments a quasi-Gaussian distribution of the mass of these fragments, completely centred on 20 g, is found.

EXAMPLE 2

The same cylindrical explosive ammunition component with controlled fragmentation as in Example 1 was produced by making use of the process according to the invention, except that, on the one hand, the explosive charge is a dual-composition plastic-bonded explosive in which the peripheral layer is less sensitive to the shock wave than the central layer and, on the other hand, the diameter of the opening of the polyethylene sleeve is 200 mm instead of 90 mm.

In the case of this Example 2 the operation is strictly as in the case of Example 1 until the stage, not included, of casting the pasty explosive composition into the sleeve.

After the sleeve has been introduced into the casing, a removable cylindrical pin 130 mm in diameter and 500 mm in height is positioned in the sleeve, axially and resting on its bottom, and then into the space situated between the pin and the inner portion of the sleeve is cast, at 60° C., a pasty explosive composition made up of 51% by weight of ammonium perchlorate, 17% by weight of HMX, 20% by weight of aluminum and 12% by weight of a polymerizable organic binder based on polybutadiene with hydroxyl ends with a mass of approximately 2000 and on isophorone diisocyanate.

The composition is solidified by polymerizing the binder by heating for 7 d at 60° C.

After withdrawal of the pin a pasty explosive composition made up of 50% by weight of HMX, 24% by weight of ammonium perchlorate, 12% by weight of aluminum and 14% by weight of a polymerizable organic binder based on polybutadiene with hydroxyl ends with a mass of approximately 2000 and on isophorone diisocyanate is cast, at 60° C., into the central space thus released.

The composition is solidified by polymerizing the binder by heating for 7 d at 60° C.

The initiation of the dual-composition charge was next produced with the aid of a PWG of 50 mm diameter reinforced with a cylinder of the same diameter and 35 mm in height made of the same plastic-bonded explosive as that employed in Example 1.

After detonation of the explosive ammunition component and recovery of the fragments, a quasi-Gaussian distribution of the mass of these fragments, completely centred on 20 g is found, as in the case of Example 1.

We claim:

1. Process for the manufacture of an explosive ammunition component with controlled fragmentation, comprising a solid explosive charge contained in a metal casing whose internal wall is clad with a sleeve externally provided with indentations, characterized in that:

a rigid sleeve made of plastic or elastomer, externally provided with indentations and which has a form of a vessel provided with a single opening, is produced first of all, the sleeve is next introduced into a metal casing comprising an opening and whose shape and the dimensions are such as to allow the sleeve to clad the internal wall of the casing, the sleeve being introduced through the opening of the casing so that the opening of the sleeve will be situated facing the opening of the casing in order to make the interior of the sleeve accessible through the opening of the casing, a pasty or liquid explosive composition is next cast into the sleeve and the composition is then solidified.

2. Process of manufacture according to claim 1, characterized in that the ammunition component has a cylindrical shape and in that the internal diameter of the casing is equal to the external diameter of the sleeve.

3. Process of manufacture according to claim 1, characterized in that the ammunition component has an ogival shape and in that the dimensions of the ogives defined by the internal wall of the casing and by the external wall of the sleeve are identical.

4. Process of manufacture according to claim 1, characterized in that the indentations are of dihedral shape.

5. Process of manufacture according to claim 2, characterized in that the sleeve is provided with crown rings comprising an identical number of identical indentations, the indentations being uniformly distributed on each crown ring and situated alternating with the indentations of the higher crown ring and those of the lower crown ring.

6. Process of manufacture according to claim 1, characterized in that the external and internal walls of the metal casing are not weakened.

7. Process of manufacture according to claim 1, characterized in that the sleeve comprises a wall of substantially uniform thickness which is between 5% and 25% of the thickness of the metal casing.

8. Process of manufacture according to claim 1, characterized in that the plastic or elastomer is chosen from the group consisting of polyalkylenes, natural elastomers and synthetic elastomers.

9. Process of manufacture according to claim 8, characterized in that the plastic is a polyethylene.

10. Process of manufacture according to claim 1, characterized in that the size of the opening of the casing is smaller than the size of the sleeve and in that the sleeve has a flexibility and an elasticity which are sufficient to enable it to be compressed without damage and then introduced into the opening of the casing.

11. Process of manufacture according to claim 1, characterized in that the castable explosive composition consists of a filled polymerizable organic binder in which the filler contains at least one organic nitro explosive and in that the composition is solidified by polymerizing the binder.

12. Process of manufacture according to claim 1, characterized in that the castable explosive composition is made up of an organic nitro explosive granular filler suspended in a fusible explosive in the molten state and in that the composition is solidified by lowering the temperature.

* * * * *